US006502862B1

(12) United States Patent
Lenhart

(10) Patent No.: US 6,502,862 B1
(45) **Date of Patent: *Jan. 7, 2003**

(54) LOOPS FOR POLES

(76) Inventor: Klaus Lenhart, Mittlerer Weg 23, D-73275 Ohmden (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/016,642

(22) Filed: Jan. 30, 1998

(30) Foreign Application Priority Data

Feb. 3, 1997 (DE) ..... 297 01 662 U

(51) Int. Cl.[7] ..... A63C 11/00
(52) U.S. Cl. ..... 280/821
(58) Field of Search ..... 280/819, 821, 280/822; 2/159

(56) References Cited

U.S. PATENT DOCUMENTS

| | | | | | |
|---|---|---|---|---|---|
| 2,095,603 | A | * | 10/1937 | Langdon | 2/159 |
| 3,163,436 | A | * | 12/1964 | Shride et al. | 280/822 |
| 3,188,090 | A | * | 6/1965 | Job | 2/159 |
| 3,582,100 | A | * | 6/1971 | Allsop | 280/821 |
| 3,879,048 | A | * | 4/1975 | Penney | 280/821 |
| 4,162,081 | A | * | 7/1979 | Joseph | 280/822 |
| 4,315,641 | A | * | 2/1982 | Larsen | 280/822 |
| 4,728,123 | A | * | 3/1988 | Kassal et al. | 280/822 |
| 4,775,168 | A | * | 10/1988 | Dalebout | 280/821 |
| 4,940,255 | A | * | 7/1990 | Donine | 280/809 |
| 5,110,154 | A | * | 5/1992 | Street | 280/822 |
| 5,294,152 | A | | 3/1994 | Jacobs | |
| 5,312,134 | A | * | 5/1994 | Goode et al. | 280/822 |
| 5,328,205 | A | * | 7/1994 | Bacharach | 280/822 |
| 5,443,287 | A | * | 8/1995 | Wells | 280/822 |
| 5,507,043 | A | * | 4/1996 | Howe | 2/159 |
| 5,887,282 | A | * | 3/1999 | Lenhart | 2/159 |

FOREIGN PATENT DOCUMENTS

| | | |
|---|---|---|
| DE | 2 306 238 | 8/1974 |
| DE | 94 01 287.3 | 5/1994 |
| FR | 691789 | 10/1930 |
| WO | WO 95/13848 | 5/1995 |

* cited by examiner

*Primary Examiner*—Robert P. Olszewski
*Assistant Examiner*—Andrew J. Fischer
(74) *Attorney, Agent, or Firm*—Jones, Tullar & Cooper, P.C.

(57) ABSTRACT

A loop for poles, such as ski poles and walking sticks, which can be fastened to a pole grip, is provided with a loop element, which encloses the wrist and whose circumference can be adjusted, with a connecting element to the pole grip for the loop element, and with a drawing element, whose one end can be fixed in place on the pole grip and the other end can be releasably fastened on the loop element. The drawing element can be releasably fastened on the exterior of the loop element, so that the drawing element can be connected with or released from the loop element in a simple manner, wherein the circumferential setting of the loop element is maintained.

9 Claims, 4 Drawing Sheets

LOOPS FOR POLES

BACKGROUND OF THE INVENTION

1. Field of the Invention

The present invention relates to a loop for poles, such as ski poles and walking sticks, which can be fastened to a pole grip with a loop element which encloses the wrist and whose circumference can be adjusted with a loop element and a drawing element.

2. Background Art

In connection with such a loop for poles, known from DE 94 01 287 U1, the drawing element has been placed with its end facing away from the pole grip between a burr-type closure arrangement of the loop element, whose circumference can be adjusted and can be connected therewith. The fastening and releasing of such a drawing element on, or respectively from, the loop element is relatively elaborate, since to this end it is necessary in every case first to open, or respectively close, the burr-type closure arrangement. This also requires the loosening, and therefore readjustment of the circumferential length of the loop element.

SUMMARY OF THE INVENTION

It is therefore an object of the present invention to provide an improved loop for poles of the type mentioned at the outset in such a way that the drawing element can be connected with, or respectively released from, the loop element in a simpler way, wherein the circumferential adjustment of the loop element is maintained.

To attain this object, poles, such as ski poles and walking sticks of the type mentioned are provided with a drawing element releasably fastened on the exterior of the loop element.

By means of the present invention the loop element no longer needs to be opened when the drawing element is connected with the loop element or is released from it. By means of this the circumferential setting of the loop element, once it has been made, is retained. This leads to easy handling of the loop With the known loop the drawing element extends over the back of the hand, since it is connected with the loop element in its adjustment area. A more optimal guidance of the drawing element results when the drawing element can be releasably fastened outside of the adjustment area of the loop element. In this case the drawing element is essentially arranged in the outer area of the hand between the thumb and index finger and is guided in its extension, which makes a more direct placement of the hand in a position on the pole grip possible. Furthermore, a stabilization and interlocking fixation in place of the hand on the pole grip results, so that an optimal force transfer from the hand to the pole is possible. Furthermore, with this type of attachment any danger of an unintended adjustment of the circumference of the loop is avoided.

By releasably fastening the drawing element outside of the adjustment area of the loop element, it is possible to achieve an individual position as a function of the hand, or respectively glove size. An advantageous embodiment of this ensues from providing at least two discrete fastening points which are provided on the drawing element and at a distance from each other.

An additional length adjustability and optimal stabilized holding of the hand on the pole grip ensues from an elastically stretchable section arranged between the fastening areas of the drawing element on the loop element or on the pole grip. In this connection it is practical to provide this elastically expandable section between the respective fastening areas on the outside of the loop element by means of a snap fastener unit.

The fastening ends of the drawing element and the connection element can be fastened so they cannot be released from the pole grip or, can be provided releasably as a unit on the pole grip. A very advantageous embodiment of releasability is provided in that the fastening ends are fastened, one resting on top of the other, on a bolt element which can be releasably inserted and locked in the pole grip.

If a circumferential adjustment by means of a burr-type closure unit is provided for a loop, it is practical to provide the drawing element directly next to an eye or a buckle provided on one end of the loop element. In the process a structurally and production-technologically simple fastening results.

For connecting the drawing elements with the loop, various releasable connecting units can be provided, such as a snap fastener unit or a tuning-lock fastener unit, or a burr-type closure connection or the like can be provided.

A useful and easy embodiment of the loop results from the provision of a web belt as the loop element which is woven wider in the contact area with the palm of the hand and narrower in the connecting area with the pole grip and in the circumferential adjustment area, while the adjustment area and the contact area of the loop element are woven as one piece with the connecting element, and while the end area of the loop element, which is firmly connected with the eye or the buckle is sewn to an intermediate area near the transition to the connecting element.

Further details of the present invention can be taken from the following description, in which the invention will be described and explained in more detail by means of the exemplary embodiments represented in the drawings. Shown are in:

DESCRIPTION OF THE PREFERRED EMBODIMENT

Figure 1:
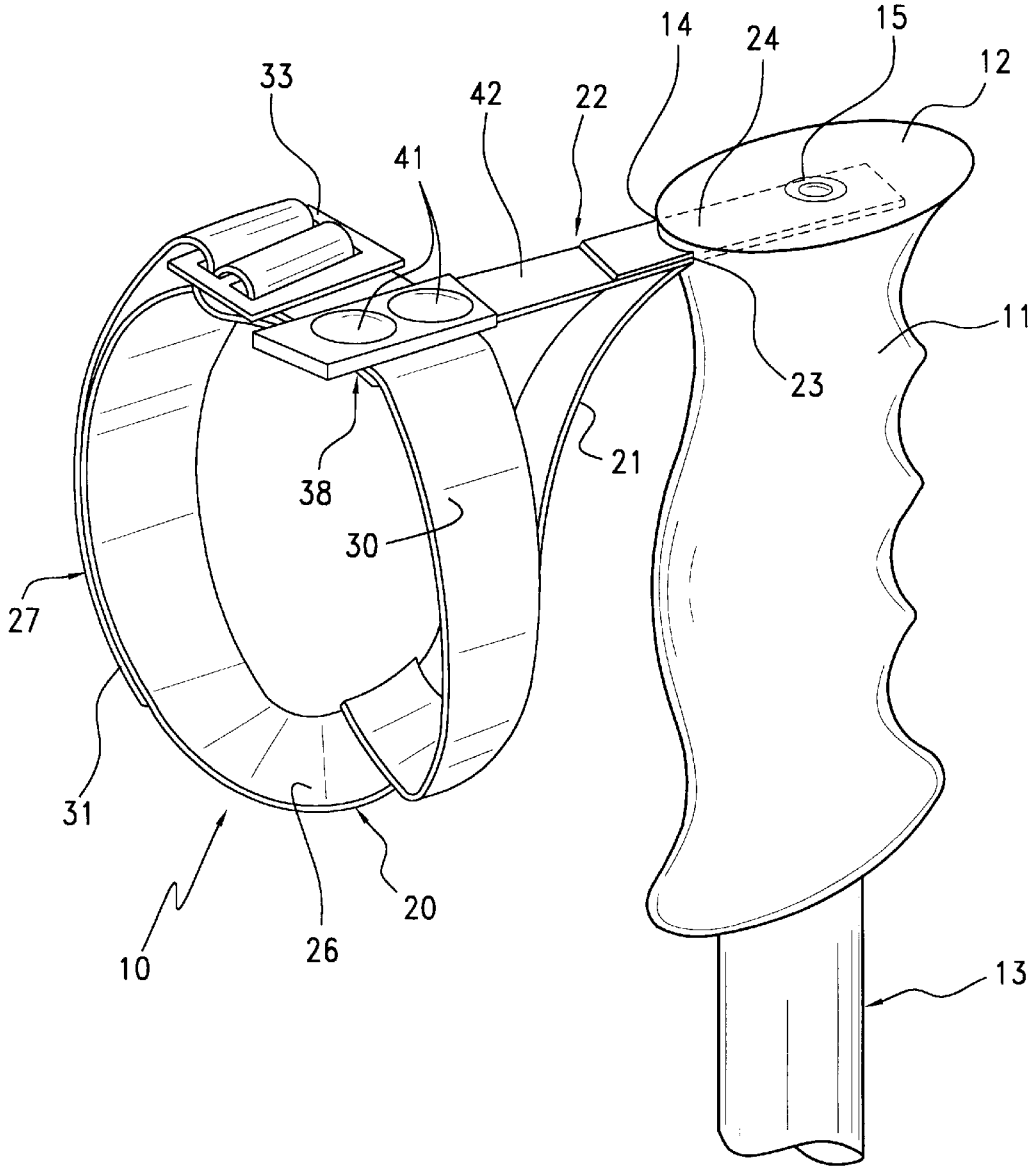
FIG. 1, is a perspective representation of a loop fastened on a pole grip in accordance with a preferred embodiment of the instant invention.

In accordance with FIG. 1, a loop 10 is fastened at the upper end 12 of a pole grip 11 of a pole 13, which can be a ski pole or a walking stick. In accordance with FIG. 1, the loop 10 has been inserted into a slit 14 of the pole grip 11 and is fastened by means of a screw 15, axially inserted into the pole grip 11. However, in accordance with FIG. 6 it is also possible to provide the fastening ends of the loop 10" on an element 110 of a releasable fastening unit of the loop and the pole grip, which is embodied in such a way that the loop 10" can be fastened, easily releasable on the pole grip 111, for example insertably and lockingly.

The loop 10 has a loop element 20, which tightly encloses the wrist of a user, a connecting element 21 and a drawing element 22. The free ends 23 and 24 of the connecting element 21 and the drawing element 22, respectively, are brought together on top of each other and are connected fixedly or easily releasable with the pole grip 11 or 111 in the manner described above.

Figure 2A:
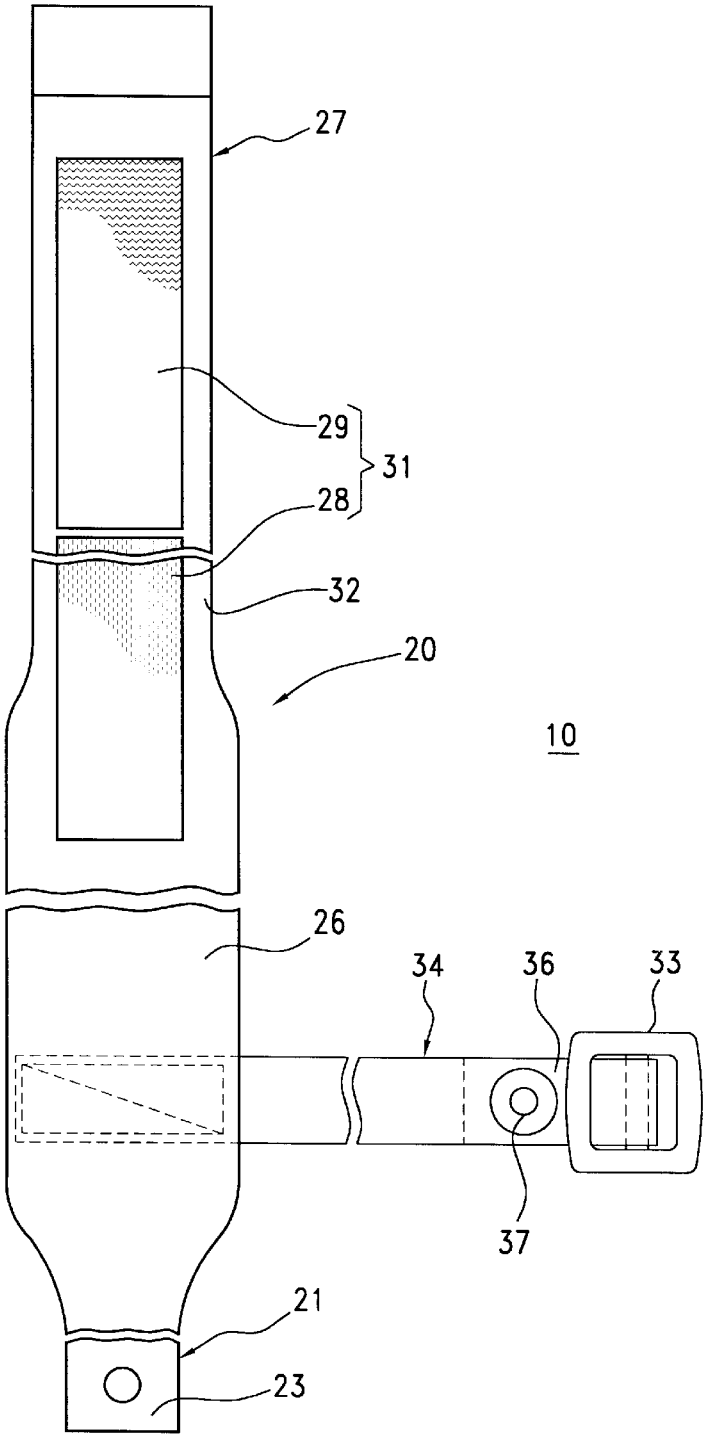
FIGS. 2A and 2B, are respectively, a bottom view of the loop element and the connecting element, and a top view of the drawing element of the loop in accordance with FIG. 1, FIG. 3, is a lateral view of an embodiment of the releasable connection of the loop element and drawing element differing from FIGS. 1 and 2, FIG. 4, is a top view in accordance with the arrow IV in FIG. 3, FIG. 5, is a section along the line V—V in FIG. 3 in an enlarged representation.
Figure 2B:
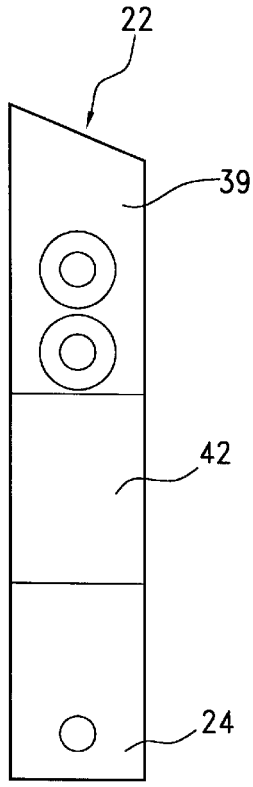

In accordance with the partial FIGS. 2A and 2B, in which the individual elements, or respectively areas, of the loop 10 are represented in a state where they are laid out flat, the loop element 20 has a widened intermediate area 26 which, in the carrying position in accordance with FIG. 1, lies in the area of the palm of the hand. At the one end, the intermediate area 26 forms a transition in one piece into the narrower connecting element 21, and at the other end forms a transition in one piece into an end area 27 of the loop element 20 embodied as an adjustable fastening area. Tape elements 28 and 29 of a burr-type closure unit 31 have been sewn one behind the other in the longitudinal direction to the underside 32 of the also narrower free fastening area 27. When the free fastening area 27 in accordance with FIG. 1 has been passed through an eye 33 or a buckle and reversed, the circumferential length of the loop element 20 can be adjusted and maintained in this way. A second end area 34 of the loop element 20 has been fastened, preferably sewn, vertically projecting from the intermediate area 26 of the loop element 20 near the transition to the connecting element 21. The free end 36 of the second end area 34 is fixedly connected with the eye 33, or the buckle, by reversing it. In the vicinity of this eye 33, the free end 36 has been provided with one part 37 of a snap fastener connector 38, wherein this snap fastener part 37, which forms a male part, simultaneously holds the reversed free end 36 for fastening in the eye and is open toward the outside 30 of the loop element 20.

In accordance with FIG. 2B, the drawing element 22 is designed to be relatively narrow and on its free end 39, which faces away from the end 24 connected with the pole grip 11, or respectively with the connecting element end 23, it has several other, for example two, snap fastener parts 41, which form female parts, arranged at a distance from each other, which can be selectively releasably connected with the male snap fastener part 37 on the connecting element 21. An elastically stretchable section 42 in the manner of a rubber band is provided between the end 24 maintained on the pole grip 11 and the free end 39 of the drawing element 22. In the carrying position in accordance with FIG. 1, the free end 39 of the drawing element 22, which has been clipped to the outside 30 of the loop element 20, is kept projecting approximately vertically from the second end area 34 of the loop element 20, and the connecting element 21 extends along the pole grip 11 and thus along the palm of the hand, while the drawing element 22 extends on the outside of the hand in an area between the thumb and the index finger.

Figure 5:
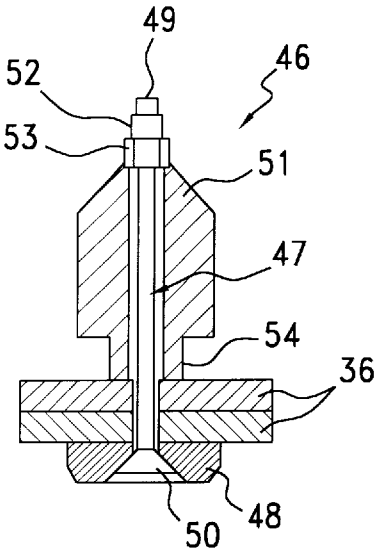
Figure 3:
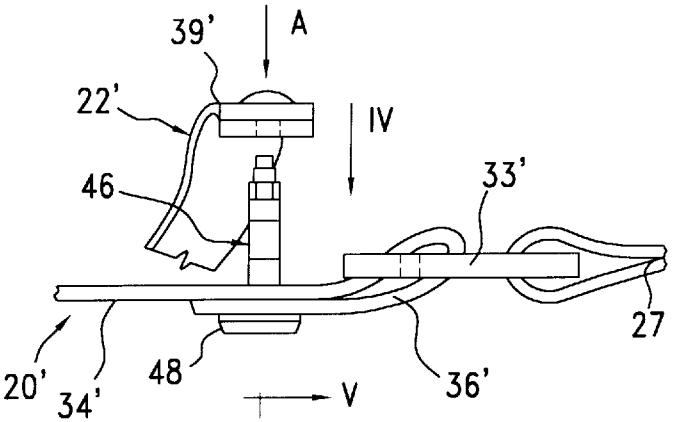
Figure 4:
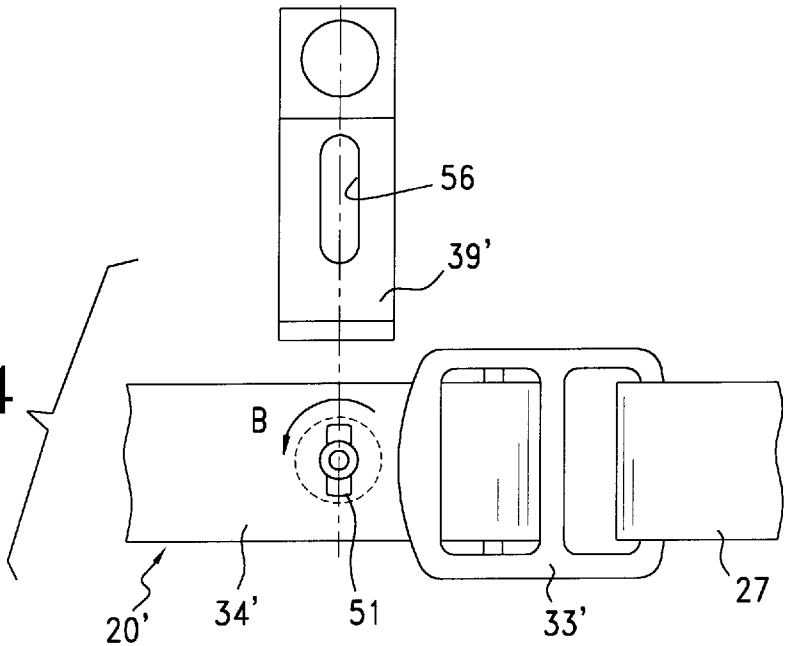

FIGS. 3 to 5 represent a variant of the loop 10 to the extent that the releasable fastening of the drawing element 22' on the second end area 34' of the loop element 20 is concerned. For this purpose the second end area 34' near the eye 33' is provided with a turning-lock fastener 46 formed by the reversed free end 36', which in this case constitutes, at the same time, the eye holder. The turning-lock fastener 46 has an axis 47 embodied as a screw, whose head 50 is held in a countersunk manner by a washer 48 maintained on the inside of the free end 36, and on whose shaft 49, which projects above the outside of the free end 36, a turning knob 51 is rotatably maintained. The turning knob 51 is secured in the axial direction via a nut 52 and washer 53. The turning knob 51 has a rectangular-shaped base surface and on its inside it is provided with an undercut 54. The drawing element 22' is provided in its free end area 39' with at least one elongated hole 56, whose cross-sectional dimensions approximately correspond to the cross-sectional dimensions of the turning knob 51. In other words, in the position of the turning knob 51 represented in FIG. 4, in which the latter extends in the direction of the elongated hole 56, the free end 39' of the drawing element 22' can be brought with its elongated hole 56 in accordance with the arrow A (FIG. 3) over the turning knob 51 in such a way, that the drawing element end 39' rests on the second end area 34' of the loop element 20', and therefore is arranged at the level of the undercut 54. The turning knob 51 can then be pivoted by 90° in the direction of the arrow B, so that the turning knob 51 extends over the drawing element end 39' on both sides of the transverse extension of the elongated hole 56. Otherwise the drawing element 22' is embodied in the same way as the drawing element 22, i.e., it also has an elastic section, not represented here. In addition it is possible to provide the drawing element 22' with more than one elongated hole 56 for a longitudinal adjustment possibility.

Figure 6:
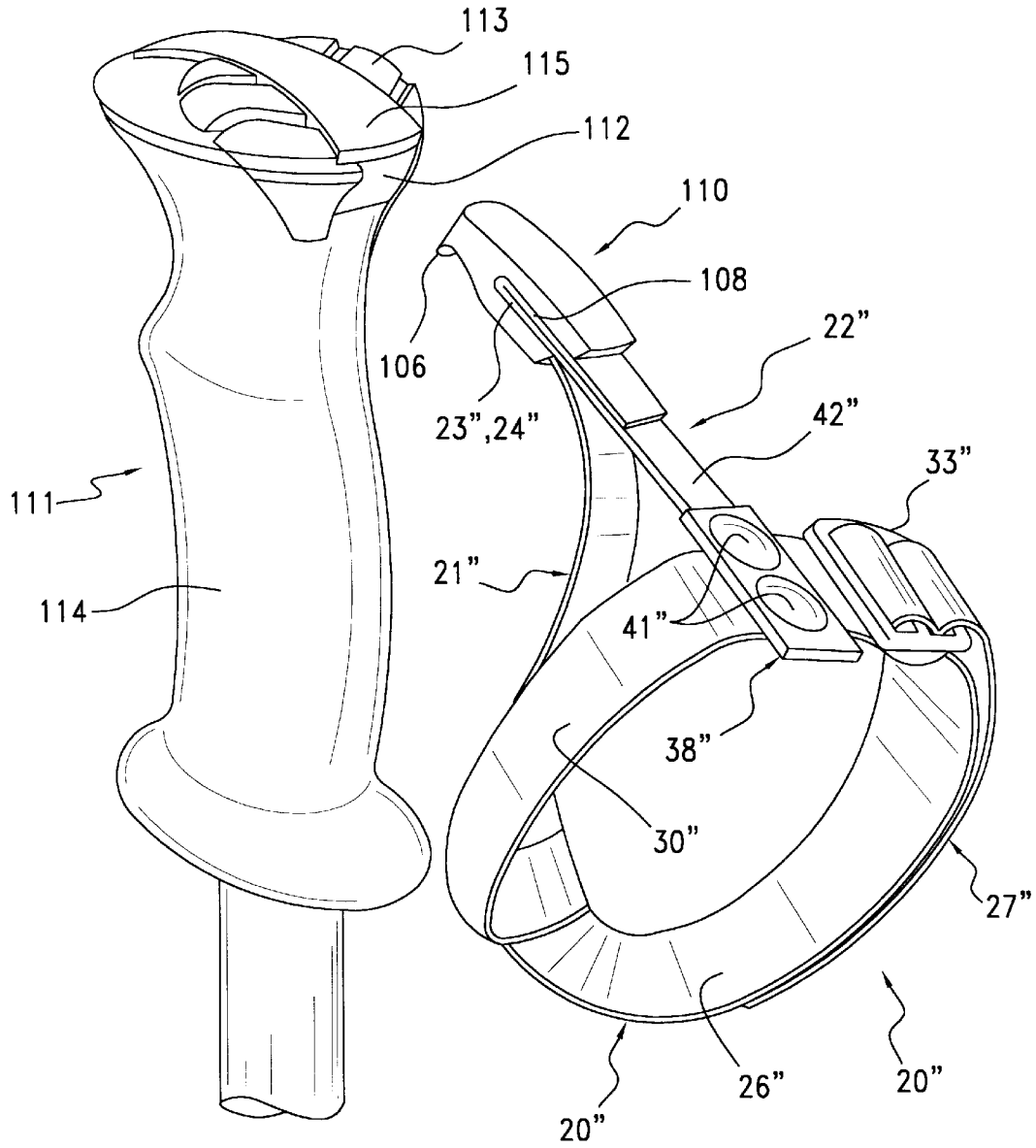
FIG. 6, is a representation corresponding to FIG. 1 wherein, however, the loop can be releasably locked on the pole grip.

As mentioned at the outset, FIG. 6 represents in a further embodiment shown as loop 10", which basically corresponds to the loop 10 in FIG. 1, so that its identical elements have been provided with the same reference numerals, but with a double prime. The essential difference between the loop 10" and the loop 10 in accordance with FIG. 1 lies in the connector, which can be inserted into the pole grip 111 and releasably locked. With the loop 10", the fastening ends 23" and 24", which are placed on top of each other, of the connecting element 21", or respectively the drawing element 22", have been inserted into a slot 108 of the bolt element 110 and are fastened in a manner not represented. The bolt element 110 provided with a projection 106 is inserted into an opening 112, which is bordered laterally by an axially movable release knob 113, on the bottom by the grip element 114 and on the top by a resiliently elastically movable cover element 115. The bolt element 110 can be inserted and locked in a manner not represented in detail inside the opening 112 in the pole grip 111. Release of the bolt element 110 from the pole grip 111 can take place either manually by means of the release knob 113, or automatically by a safety release in a direction essentially extending toward the cover element 115.

What is claimed is:

1. A loop and pole combination, comprising:

a first continuous loop element having an adjustable end, a pole end and a first intermediary area between the two ends, said first continuous loop element being inseparable;

a second continuous loop element having a first end, a second end and a second intermediary area between said first end and said second end of said second continuous loop element, said first end being connected to said adjustable end of said first continuous loop element via a buckle, and said second end being connected to said first intermediary area of said first continuous loop element; wherein said first continuous loop element and said second continuous loop element are adapted to enclose the wrist of a user, said adjustable end of said first continuous loop element having an adjustment area for adjusting the circumference of said first and second continuous loop elements about the wrist of the user; and a drawing element having a free end and a fastening end with an elastically stretchable section between said free end and said fastening end, said free end of said drawing element being releasably fastened to said second intermediary area of said second continuous loop element, wherein said fastening end of said drawing element overlaps said pole end of said first continuous loop element with said fastening end and said pole end being connectable to the pole.

2. The loop as defined in claim 1, wherein said drawing element is adjustable in length.

3. The loop as defined in claim 2, wherein said drawing element has two discrete fastening points arranged at a distance from each other.

4. The loop as defined in claim 1, wherein said pole end of said first continuous loop element and said fastening end of said drawing element are adapted to be releasably fastened together at the grip of the pole.

5. The loop as defined in claim 1, wherein said pole end of said first continuous loop element and said fastening end of said drawing element are adapted to be releasably fastened together at the slot of the grip.

6. The loop and pole combination as defined in claim 5, further comprising:

a bolt element, wherein said includes a free end, said free end of said connecting element and said fastening end of said drawing element are adapted to rest one on top of the other and on said bolt element, and wherein said bolt element is adapted to be releasably inserted and locked in the grip of the ski pole or the walking stick.

7. The loop and pole combination as defined in claim 1, further comprising:

a burr-closure unit mounted to said loop element, wherein:

said first continuous loop element includes one of: an eye and a buckle, said drawing element being releasably fastened at its end near said eye or buckle, and the circumference of said first continuous loop element is adjusted by pulling its one end through said eye or buckle.

8. The loop and pole combination as defined in claim 7, further comprising:

a fastening element for fastening said drawing element on said first continuous loop element.

9. The loop and pole combination as defined in claim 1, further comprising:

a snap fastener unit, wherein:

said drawing element is releasably fastened on the outside of said first continuous loop element by means of said snap fastener unit.

* * * * *